US010358848B2

(12) United States Patent
Scholz et al.

(10) Patent No.: US 10,358,848 B2
(45) Date of Patent: Jul. 23, 2019

(54) MOTOR VEHICLE DOOR LOCK

(71) Applicant: Kiekert Aktiengesellschaft, Heiligenhaus (DE)

(72) Inventors: Michael Scholz, Essen (DE); Armin Handke, Duisburg (DE); Omer Inan, Dorsten (DE); Radek Mazal, Chleny (CZ)

(73) Assignee: Kiekert Aktiengesellschaft, Heiligenhaus (DE)

( * ) Notice: Subject to any disclaimer, the term of this patent is extended or adjusted under 35 U.S.C. 154(b) by 661 days.

(21) Appl. No.: 14/426,398

(22) PCT Filed: Sep. 5, 2013

(86) PCT No.: PCT/DE2013/000515
§ 371 (c)(1),
(2) Date: Mar. 6, 2015

(87) PCT Pub. No.: WO2014/036991
PCT Pub. Date: Mar. 13, 2014

(65) Prior Publication Data

US 2015/0233156 A1 Aug. 20, 2015

(30) Foreign Application Priority Data

Sep. 7, 2012 (DE) ..... 10 2012 017 677

(51) Int. Cl.
*E05B 85/20* (2014.01)
*E05B 85/26* (2014.01)
*E05B 81/14* (2014.01)

(52) U.S. Cl.
CPC ..... *E05B 85/20* (2013.01); *E05B 81/15* (2013.01); *E05B 85/26* (2013.01); *Y10T 292/108* (2015.04); *Y10T 292/1075* (2015.04)

(58) Field of Classification Search
CPC ..... Y10T 292/108; Y10T 292/1055; Y10T 292/1078; Y10T 292/308; Y10T 70/5889;
(Continued)

(56) References Cited

U.S. PATENT DOCUMENTS 6,371,536 B1 * 4/2002 Koerwer ..... E05B 81/14 292/201
6,581,988 B1 * 6/2003 Mihail ..... E05B 85/26 292/216

(Continued)

FOREIGN PATENT DOCUMENTS

DE 19617428 A1 11/1997
DE 4042678 C1 10/1999

(Continued)

OTHER PUBLICATIONS

Machine translation of JP09303025A by Lexis Nexis Total Patent on Jun. 21, 2017.

(Continued)

*Primary Examiner* — Mark A Williams
(74) *Attorney, Agent, or Firm* — Woodard, Emhardt, Henry, Reeves & Wagner, LLC

(57) ABSTRACT

The subject matter of the present invention is a motor vehicle door lock, the basic construction of which is equipped with a locking mechanism (1, 2) consisting essentially of a rotary latch (1) and a detent pawl (2), furthermore with a release element (3) for the locking mechanism (1, 2) and with a storage element (4). The storage element (4) ensures an unobstructed opening movement of the rotary latch (1) from a closed position into an open position. According to the invention, for this purpose, the storage element (4) holds the release element (3) during the opening movement of the rotary latch (1) in an ineffective position with respect to the locking mechanism (1, 2).

10 Claims, 5 Drawing Sheets

(58) Field of Classification Search
CPC ..... Y10S 292/23; Y10S 292/62; E05B 85/26; E05B 81/14; E05B 81/16; E05B 81/15
See application file for complete search history.

(56) References Cited

U.S. PATENT DOCUMENTS

| | | | | |
|---|---|---|---|---|
| 8,894,107 | B2 * | 11/2014 | Kamata | B60N 2/01583 292/194 |
| 2005/0001437 | A1 * | 1/2005 | Brose | E05B 85/26 292/216 |
| 2005/0121922 | A1 * | 6/2005 | Cetnar | E05B 81/20 292/216 |
| 2006/0012186 | A1 * | 1/2006 | Zillert | E05B 81/20 292/216 |
| 2006/0055181 | A1 * | 3/2006 | Berghahn | E05B 81/20 292/216 |
| 2011/0205660 | A1 * | 8/2011 | Komura | B82Y 20/00 360/59 |
| 2011/0316293 | A1 * | 12/2011 | Luschper | E05B 79/20 292/195 |
| 2012/0181798 | A1 * | 7/2012 | Margheritti | E05B 77/32 292/200 |

FOREIGN PATENT DOCUMENTS

| | | | | |
|---|---|---|---|---|
| DE | 10130260 | A1 | 10/2002 | |
| DE | 20 2004 019 060 | U1 | 4/2006 | |
| DE | 102006032033 | A1 * | 3/2007 | E05B 81/14 |
| DE | 102006032033 | A1 | 3/2007 | |
| DE | 202012002867 | U1 | 5/2012 | |
| DE | 102010061427 | A1 | 6/2012 | |
| EP | 1818484 | A1 | 8/2007 | |
| JP | 09303025 | A1 | 11/1997 | |
| JP | 09393925 | A * | 11/1997 | |

OTHER PUBLICATIONS

Machine Translation of DE102006032033A1 by Lexis Nexis Total Patent on Apr. 3, 2015.
Machine Translation of DE102010061427A1 by Lexis Nexis Total Patent on Apr. 3, 2015.
Machine Translation of DE202012002867U1 by Lexis Nexis Total Patent on Apr. 3, 2015.
Machine Translation of DE4042678C1 by Lexis Nexis Total Patent on Apr. 3, 2015.
Machine translation of DE10130260A1 by Patent Translate European Patent Office dated Dec. 14, 2018 (pp. 19).
Machine translation of DE19617428A1 by Patent Translate European Patent Office dated Dec. 17, 2018 (pp. 16).
Machine translation of DE202004019060U1 by Patent Translate European Patent Office dated Dec. 17, 2018 (pp. 26).

* cited by examiner

MOTOR VEHICLE DOOR LOCK

CROSS-REFERENCE TO RELATED APPLICATIONS

This application is the U.S. national stage application of International Patent Application No. PCT/DE2013/000515, filed Sep. 5, 2013, which claims priority of German Application No. 10 2012 017 677.5, filed Sep. 7, 2012, which are both hereby incorporated by reference.

BACKGROUND

The invention relates to a motor vehicle door lock with a locking mechanism essentially comprising a rotary latch and pawl as well as a release element for the locking mechanism and a storage element, ensuring an unobstructed opening movement of the rotary latch from a closed into an open position.

In a motor vehicle door lock of the described design and as disclosed in DE 10 2006 032 033 A1, the storage element ensures that when in a storage position, the pawl is kept in its release position when the rotary latch is rotated out of its closed position until it passes the initial locking position. For this purpose, the storage element contains a support section assigned to the release element, moving in front of a storage stage of the rotary latch upon actuation of the release element in order to reach the storage position. This storage stage is exited again once the initial locking position has been passed. The storage element thus prevents that the pawl can unintentionally engage (again) with the rotary latch during the opening movement of the rotary latch. Such operational states are, for instance, feasible in tailgates and in the event that they are, for instance, covered by a snow load.

In a motor vehicle door closure according to DE 40 42 678 C1, a storage lever is assigned to a triggering lever as a storage element. In the storage position of the storage element the pawl is retained in the open position until the rotary latch has been completely opened by manual opening of a respective motor vehicle door. In this way it should be ensured that where, for instance, opening of the motor vehicle door is actuated remotely but is not executed fully, the pawl is prevented from engaging in the rotary latch (again) and the door can not (no longer) be opened. Such an operational state can occur when the motorized drive for disengaging the pawl is returned to its base position after the remote control opening signal.

Not all aspects of prior art embodiments are satisfactory. The design disclosed in DE 40 42 678 C1 is relative complex, using numerous levers. DE 10 2006 032 033 A1 has simplified this point, as the storage element now contains a support section assigned to the release element. The storage element does, however, still act on the pawl in order to retain it in its release position. As soon as the functionality of the storage element is impaired in any way, the pawl can still engage with the rotary latch, so that malfunctioning must be feared. The invention aims to remedy this.

SUMMARY

The invention is based on the technical problem of further developing said motor vehicle door lock in such a way that whilst using a simple design, the greatest possible reliability is provided.

In order to solve this technical problem, a generic motor vehicle door lock of the invention is characterised in that the storage element retains the release element in an ineffective position with respect to the locking mechanism during the opening movement of the rotary latch.

In contrast to prior art as disclosed, for instance, in DE 10 2006 032 033 A1, the storage element does not act on the pawl but instead on the release element. The storage element ensures that the release element is retained in an ineffective position with respect to the locking mechanism during the opening movement of the rotary latch. In other words, the storage element actually acts on the release element and not on the pawl.

In order to ensure that in this constellation the pawl does not automatically engage the rotary latch, the pawl is advantageously pretensioned in the direction of a disengaged position. This is typically ensured by a spring assigned to the pawl, consequently keeping the pawl out of the engagement area with the rotary latch. In this way, a particularly reliably functioning arrangement with a simple design is provided. Due to its selected pretensioning, the pawl cannot as such interact with the rotary latch or only when a blocking lever assigned to the pawl acts upon the pawl accordingly so that it can engage in the main locking position or can interact with a main latching edge of the rotary latch.

In all other cases the rotary latch is anyway disengaged from the pawl. As, in addition, the storage element retains the release element in its ineffective position, the rotary latch carries out the opening movement with basically no mechanical influence. An unintentional blocking or impeding of this opening movement of the rotary latch from its closed to its open position can consequently already not occur in principle. Compared to prior art embodiments, functional reliability has increased considerably as a result.

A further advantage is that the design is particularly simple as the storage element is advantageously connected to the release element and regularly interacts with a storage stage. This storage stage can be provided on the rotary latch. This means that for the storage element to be effective, the storage element only has to rest against the storage stage and glides along it and that, in this way, the release element coupled to the storage element is held in its ineffective position with respect to the locking mechanism. This applies, in any case for the entire path of the storage element along the storage stage.

For this purpose, the storage element advantageously contains a tappet interacting with the storage stage. The tappet and storage stage regularly contain corresponding sloping surfaces. In this way the tappet can be moved from a detent position engaging the storage stage into a release position gliding along the storage stage. In order to cause such a movement the release element only has to be acted on accordingly. As soon as the release element is, for instance, pivoted from the detent position of the tappet into a release position, the corresponding sloping surfaces of the tappet and of the storage stage glide along each other and the tappet moves from its detent position, engaging the storage stage, into the release position.

As already explained, the tappet and thus the storage element glides along the storage stage in the release position of the rotary latch. The ineffective position of the release element relating to the locking mechanism corresponds to this. This means that as long as the tappet glides along the storage stage in the release position, the release element is unable to interact with the locking mechanism, as it is in an ineffective position with respect to the locking mechanism.

The storage stage is regularly arch-shaped and has a radius adapted to its distance from the rotary axis of the rotary latch and can extend over an angle of less than 120°, and preferably less than 90° and even more preferably of 50°. As a result, the opening rotary latch ensures that the release element is retained in the ineffective position, as long as the tappet glides along the arch-shaped storage stage. As soon as the tappet leaves or is able to leave the arch-shaped storage stage, the rotary latch can in principle me moved into a closing position or into the closed position. In one embodiment, an angle of 47° is used, i.e. the arch-shaped storage stage extends over an angle area of 47° along an outer edge of the rotary latch, ensuring that the triggering lever is being reliably kept away.

A respective closing movement of the rotary latch corresponds to the two sloping surfaces of the tappet, on one hand, and the storage stage, on the other hand, gliding along each other. This occurs as part of the closing movement of rotary latch until the rotary latch has reached its closed position or main locking position. The pawl then also engages in the respective main latching edge of the rotary latch. This is ensured by the blocking lever assigned to the pawl, which in this case is pivoted with the aid of a spring into a position, moving the pawl into the main detent position of the rotary latch against the force of its own spring. The blocking lever in turn is assigned to the release element.

Depending on the main locking position of the locking mechanism, the release element is able to remove or pivot away the blocking lever from its seat against the pawl. As a result, the pawl is moved by the force of the spring into the position that is disengaged from the rotary latch. At the same time, impinging of the release element ensures that the storage element with its tappet is moved from the previously assumed engaging detent position with respect to the storage stage into the release position, gliding along the storage stage. From this operating position the rotary latch can move by itself with the aid of the spring from its closed to its open position without influence of the pawl and the release element. In the open position, the rotary latch releases a previously retained locking bolt, so that a respective motor vehicle door can be easily opened by an operator.

All of this is achieved by an embodiment with a reliable design, requiring a minimum of components. The release element and the storage element are actually regularly designed as a single unit or single component. The unit comprising the release element and the storage element can at least partially be made of plastic. In the same way, the rotary latch and the storage stage can be provided as a single unit. This unit may be made of plastic or metal.

According to the invention, the rotary latch does or can also during the described closing process and prior to reaching its closed position or main locking position also assume an initial locking position. For this purpose the pawl can contain another lever connected to the release element in a rotationally fixed manner. This additional lever can interact with a protrusion on the rotary latch when assuming the initial locking position but is in general not required. These are the main advantages of the invention.

Below the invention is explained in detail with reference to drawings showing only one embodiment, in which:

DETAILED DESCRIPTION OF THE DRAWINGS

Figure 1:
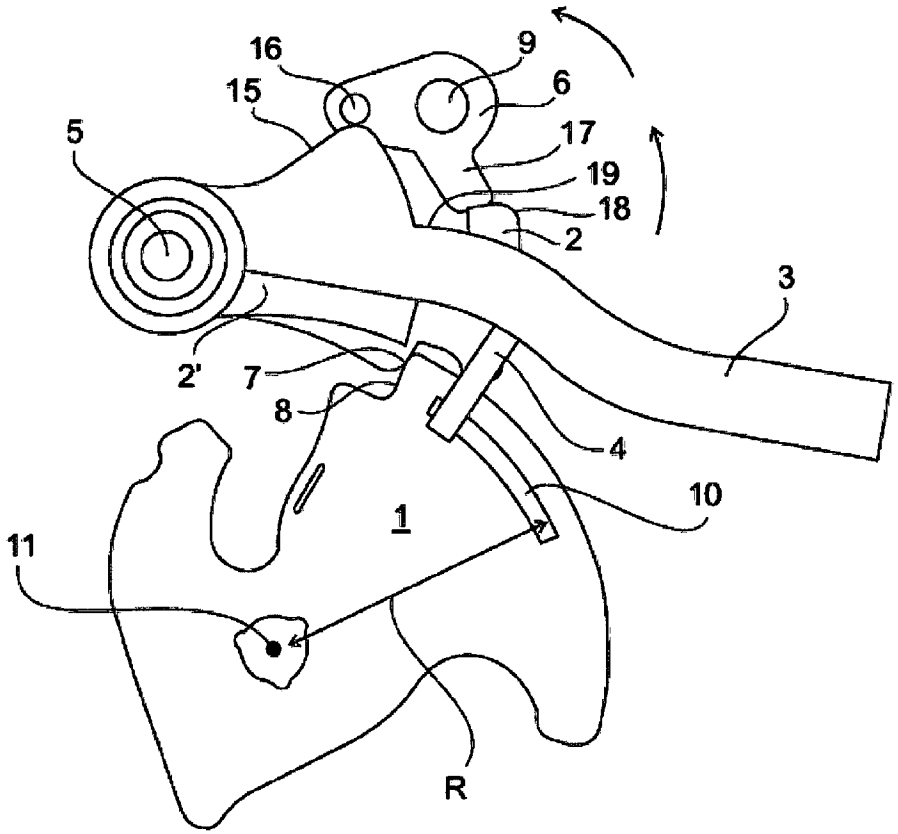
FIGS. 1 to 4 show the motor vehicle door lock of the invention reduced to the locking mechanism and elements interacting therewith in different operating positions and FIG. 5 shows a perspective view of a detail of the storage element with the respective tappet.

The figures show a motor vehicle door lock, the basic construction of which is equipped with a locking mechanism 1, 2 consisting essentially of a rotary latch 1 and pawl 2. Furthermore, a release element 3 is provided for the locking mechanism 1, 2. In addition, the basic construction includes a storage element 4, ensuring an unobstructed opening movement of the rotary latch 1 from a closed into an open position. The effect of the storage element 4 is particularly apparent, when the closed position of the rotary latch 1 shown in FIG. 1 is compared with the open position shown in FIG. 3 or the fully opened position as shown in FIG. 4.

The invention achieves said unobstructed opening movement of the rotary latch 1 from its closed into its open position by the storage element 4 holding the release element 3 during the opening movement of the rotary latch 1 in its ineffective position with respect to the locking mechanism 1, 2. The pawl 2 is also ineffective in this case. In the embodiment this is ensured by a spring—not explicitly shown—pretensioning the pawl 2 in relation to its axis of rotation 5 in counter-clockwise direction as shown in FIG. 1 and indicated by a respective arrow in this figure. This means that the pawl 2 is pretensioned in the direction of a disengaging position with the rotary latch 1.

In the closed position of the locking mechanism 1, 2 or of the main locking position of the rotary latch 1 shown in FIG. 1, the blocking lever 6 assigned to the pawl 2 ensures that an edge 7 of the pawl 2 rests against a main locking stage 8 of the rotary latch 1 and that the edge 7 is not pivoted away from the main locking stage 8 or main latching edge in the indicated counter-clockwise direction. Such a pivoting movement is prevented by said blocking lever 6, also assigned to the release element 3.

The release element 3 is a triggering lever 3, designed as a single-arm lever and mounted on the same axis as the pawl 2 and pivotable around the common axis or axis of rotation 5. In contrast, the blocking lever 6 assigned to the release element or triggering lever 3 has its own axis or axis of rotation 9, around which the blocking lever 6 is pivotably mounted. In the example embodiment the blocking lever 6 can, for instance also contain a spring, pretensioning the blocking lever 6 in counter-clockwise direction in respect to its axis of rotation 9, as shown by another arrow in FIG. 1.

According to the invention, the storage element 4 is connected to the release element or the triggering lever 3. The storage element 4 is actually an extension arm connected at an angle to the lengthwise extending triggering lever 3. In the example embodiment, the release element 4 or the respective extension arm is connected at right angles or at nearly right angles to the lengthwise extending triggering lever 3. In any case, the release element or the triggering lever 3 and also the storage element 4 or the corresponding extension arm actually define a single unit 3, 4, that can be made wholly or partially of plastic.

A storage stage 10 is assigned to the storage element 4. In the example embodiment, the storage stage 10 is provided on the rotary latch 1 and is in this case designed as an arcuate web. The web can be formed in a plastic casing of the metal rotary latch 1. The storage stage 10 actually has a radius R, adapted to the distance of the storage stage 10 from the axis of rotation 11 of the rotary latch 1.

Figure 5:
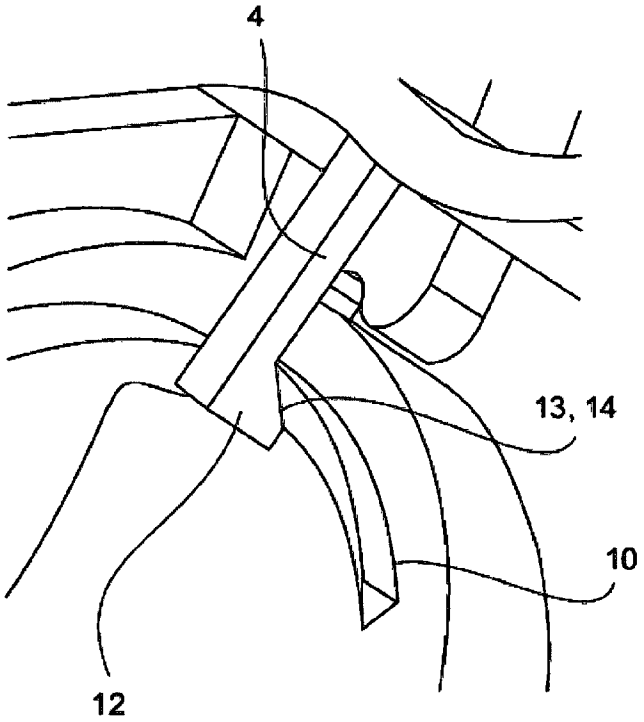

The storage element 4 contains a tappet 12 interacting with the storage stage 10, as shown in the detailed perspective view of FIG. 5. The tappet 12 and the storage stage 10 contain corresponding sloping surfaces 13, 14, adapted to each other. The tappet 12 can, altogether assume two different base positions in relation to the storage stage 10.

In the operating position shown in FIG. 1 the tappet 12 is, for instance, in the detent position engaging the storage stage 10. In contrast, the operating positions shown in FIGS. 2 and 3 correspond to the tappet 12 gliding along the storage stage 10. This includes the release position of the tappet 12 and thus the release position of the storage element 4 or of the release element 3, steered by the storage element 4. In the release position, the release element 3 is released from the locking mechanism 1, 2, i.e. is located in an ineffective position.—Such a release position is also shown in FIG. 4, in which there is no interaction between the nose 12 on one hand and the storage stage 10 on the other hand. The release element 3 is, in any case, unable to mechanically impinge on either the pawl 2 or the rotary latch 1 in any way in its release position.

Figure 2:
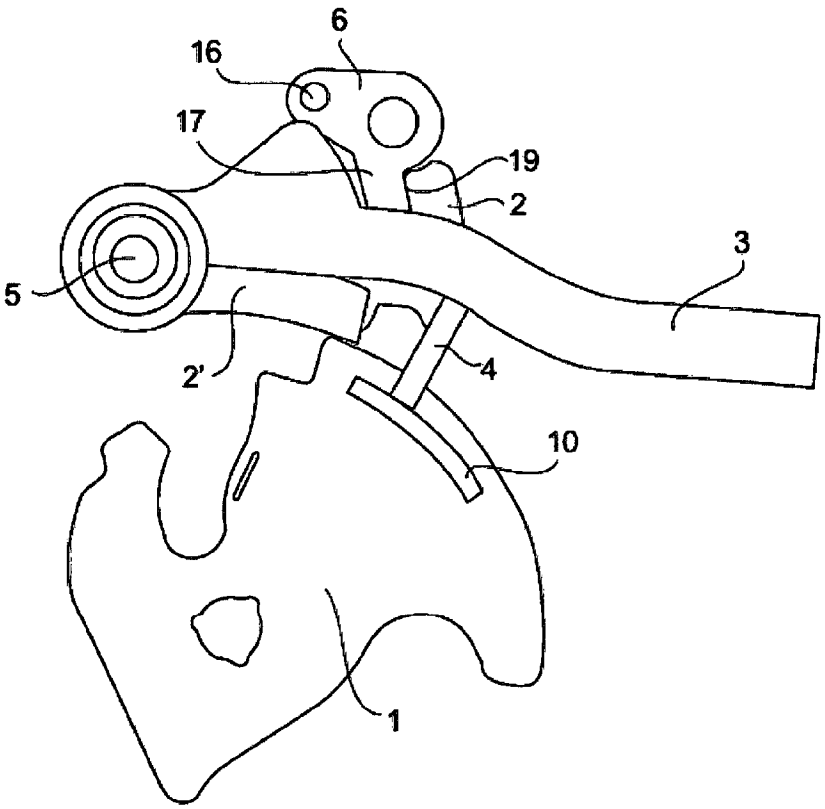
Figure 3:
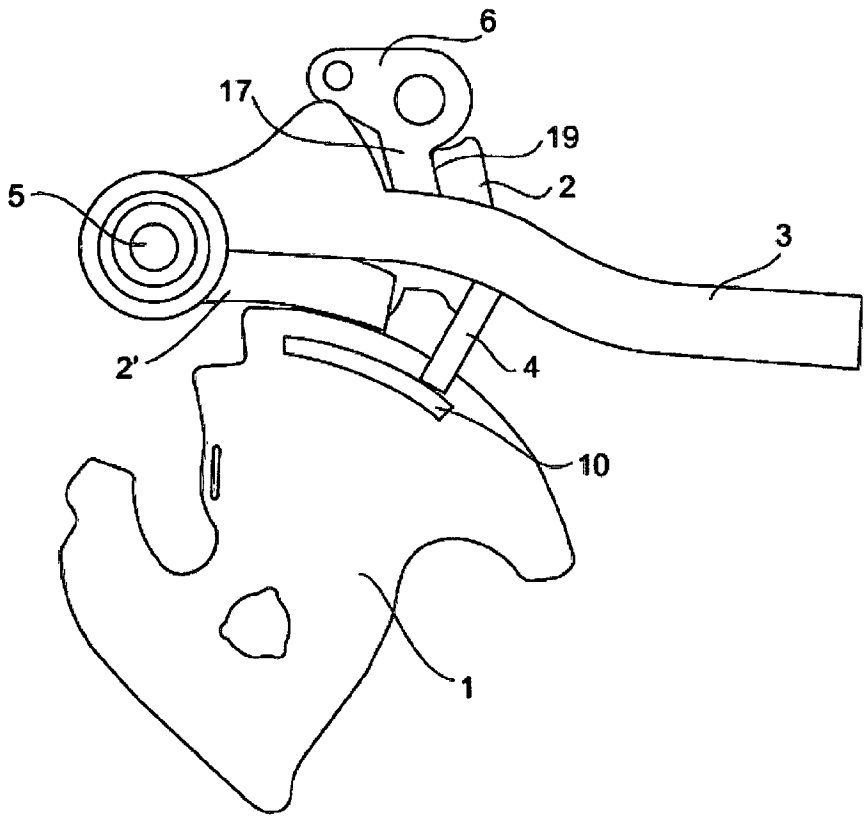
Figure 4:
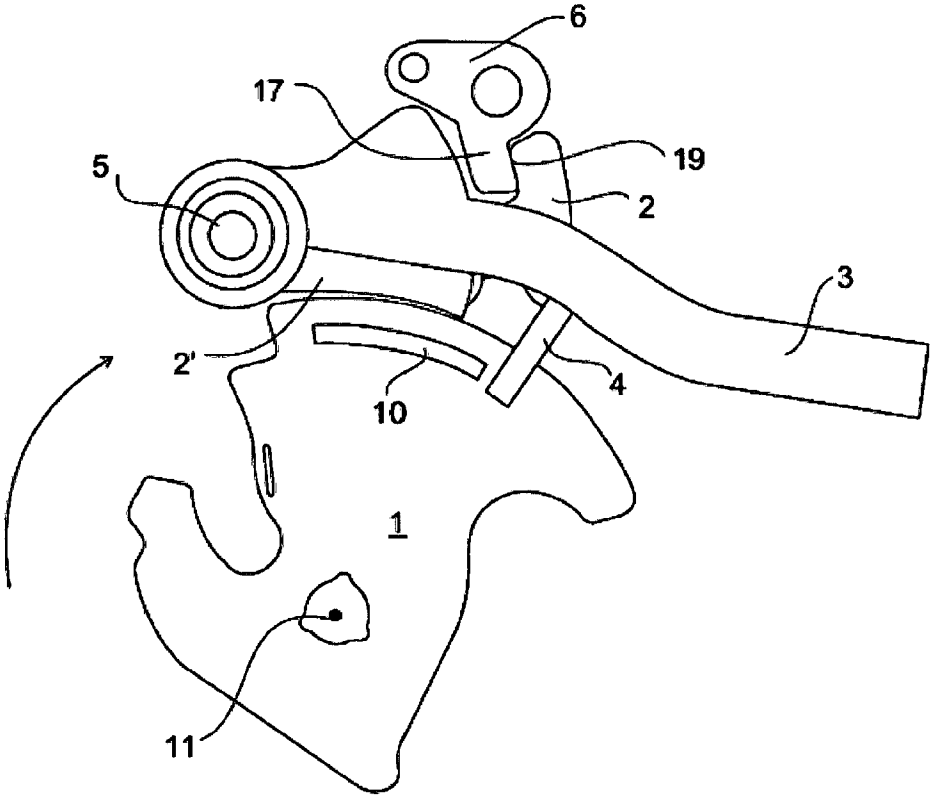

During the transition from the main locking position shown in FIG. 1 with the tappet 12 being in the detent position with respect to the storage stage 10, into the release position of the tappet 12 with respect to the storage stage 10, as shown in FIGS. 2 and 3, the tappet 12 is being impinged on by the release element 3 in such a way that the two sloping surfaces 13, 14 glide past each other, until the tappet 12 overlaps the storage stage 10. As a result, the tappet 12 can glide along the storage stage 10 on the outside or edge side of the storage stage 10, as shown in FIGS. 2 and 3. In this release position, interactions between the release element 3 and the locking mechanism 1, 2 are not possible, as the release element 3 is, so to speak, lifted off the locking mechanism 1, 2. As, in this case, the pawl 2 can also not interact with the rotary latch 1 or is pivoted by means of the spring away from the rotary latch 1 around its axis or axis of rotation 5, the rotary latch 1 is able to carry out an unobstructed opening movement. This is due to the fact that the storage element 4 holds the release element 3 in the ineffective position with respect to the locking mechanism 1, 2 during this opening movement of the rotary latch 1.

The opening movement of the rotary latch 1 follows the main locking position as shown in FIG. 1 and is primarily shown in FIGS. 2 and 3. As soon as the rotary latch 1 has reached the operating position shown in FIG. 4, the tappet 12 leaves the storage stage 10. The release element 3 is then able to pivot around its axis or axis of rotation 5 in clockwise direction (with the aid of the spring), as apparent in the transition from FIG. 3 to FIG. 4.

As a result, the rotary latch 1 is in a kind of readiness state for a subsequent closing operation. When starting from the open or fully open position shown in FIG. 4, the rotary latch 1 is impinged on in closing direction in such a way that it pivots around its shown axis or axis of rotation 11 in clockwise direction and starting from the operating position shown in FIG. 4, the tappet 12 on the storage element 4 is able to engage the storage stage 10. At the end of this closing movement starting in FIG. 4, the rotary latch 1 assumes the position shown in FIG. 1 or the main locking position.

Before this operation, an optional ratchet lever 2' on the pawl 2 can interact with a protrusion—not shown—on the rotary latch 1. This means that before, starting from the fully opened position in FIG. 4, the rotary latch 1 reaches the fully closed position or main locking position shown in FIG. 1, said ratchet lever 2' interacts with the protrusion on the rotary latch 1. This corresponds with an initial locking position of the locking mechanism 1, 2, which generally is, however, not required and is only mentioned for the sake of completeness.

As soon as the rotary latch 1 has reached the position shown in FIG. 1 during its closing movement, i.e. a clockwise rotation around its axis of rotation 11, the pawl 2 or its edge 7, previously gliding along the rotary latch 1, can interact with the main locking stage 8 on the rotary latch 1. In this case the blocking lever 6 actually ensures that the pawl 2, pretensioned in counter-clockwise direction, engages in said main locking stage 8. For this purpose, the blocking lever 6 is—as described above—also pretensioned in counter-clockwise direction around its axis 9 by means of a spring.

As soon as the rotary latch 1 has reached the position shown in FIG. 1, the pawl 2 is, so to speak, pushed into the main locking position of the rotary latch 1 with the aid of the blocking lever 6 or the edge 7 on the pawl 2 is pivoted towards the main locking stage 8 on the rotary latch 1 with the aid of the blocking lever 6. In the corresponding operating position shown in FIG. 1, the locking mechanism 1, 2 is thus in the main locking position.

In order to leave this position, the release element 3 must first of all be pivoted in counter-clockwise direction around its own axis of rotation 5, as apparent from the transition between FIG. 1 and FIG. 2. During this process, not only the storage element 4 or its tappet 12 leaves the storage stage 10 and its engaging detent position with respect to this storage stage 10. Instead, also an edge 15 on the release element 3 ensures that a pin 16 of the blocking lever 6, abutting the edge 15, is impinged on in the main locking position shown in FIG. 1.

The edge 15 on the release element 3 actually impinges on the pin 16 of the blocking lever 6 in such a way that the blocking lever 6 is moved in clockwise direction around its axis 9 during the transition from FIG. 1 to FIG. 2, and against the force of the spring assigned to the blocking lever 6. As a result, the blocking lever 6 and its extension arm 17 leaves a tappet 18 on the pawl 2, against which the extension arm 17 was first abutting in the main locking position as shown in FIG. 1. As a result, the extension arm 17 moves into a recess 19 on the pawl 2. At the same time, the pawl is moved by the force of the spring around its axis of rotation 5 in counter-clockwise direction and thus away from the rotary latch 1. The operating position shown in FIG. 2 has been reached.

The extension arm 17 on the blocking lever 6 only leaves the recess 19 on the pawl 2 again when, starting from the operating position shown in FIG. 4, the rotary latch 1 is moved to the main locking position of FIG. 1. The blocking lever 6 is then able to push the edge 7 of the pawl 2 into the main locking stage 8. During this process, the extension arm 17 of the blocking lever 6 slides along the recess 19 until the extension arm 17 rises up from the tappet 18 of the pawl 2, blocking the pawl 2 in the then reached main locking position, shown in FIG. 1. In this position, the pawl 2 can consequently not pivot around its axis of rotation 5 in counter-clockwise direction.

The shown motor vehicle door lock can be designed as a motor vehicle door lock for a motor vehicle side door. Generally the motor vehicle door lock is, however, a lock for a tailgate or a tailgate lock. The additional ratchet lever 2' is thus not required on the pawl 2. This means that in this case no two-pawl locking mechanism is provided but the locking mechanism 1, 2 is only able to assume the main locking position shown in FIG. 1 and obviously the open position, as shown in FIG. 4 as end positions.

As already explained above, the release element 3 and the storage element 4 can be produced as part of the same production process, with the used unit 3, 4 being essentially made of plastic. In contrast, the additional ratchet lever 2" is in most cases made of metal. The ratchet lever 2" is generally connected to the release element 3 in a rotationally fixed manner.

The invention claimed is:

1. A motor vehicle door lock having a locking mechanism comprising:

a rotary latch rotatable between a closed position and an open position, a pawl rotatable about an axis of rotation and rotatable between a locked position where the pawl retains the rotary latch in the closed position and an unlocked position where the pawl does not block movement of the rotary latch from the closed position to the open position, a blocking lever movable between a blocking position where the blocking lever retains the pawl in the locked position and an unblocking position where the blocking lever does not block movement of the pawl from the locked position to the unlocked position, a triggering lever movable to a releasing position where the triggering lever moves the blocking lever to the unblocking position, a storage stage on the rotary latch, and a storage element on the triggering lever, wherein the storage element engages the storage stage to retain the triggering lever in the releasing position when the release lever is moved to the releasing position.

2. The motor vehicle door lock of claim 1, wherein the triggering lever rotates about the axis of rotation of the pawl.

3. The motor vehicle door lock of claim 1, wherein the storage stage is an arch-shaped protrusion with a radius adapted to the distance of the axis of rotation of the rotary latch.

4. The motor vehicle door lock of claim 3, wherein the arch-shaped protrusion extends over an angle of less than 120°.

5. The motor vehicle door lock of claim 3, wherein the arch-shaped protrusion extends over an angle of less than 90°.

6. The motor vehicle door lock of claim 3, wherein the arch-shaped protrusion comprises a first sloped surface and a first vertical surface.

7. The motor vehicle door lock of claim 6, wherein the storage element includes a tappet having a second sloped surface and a second vertical surface, wherein the first and second vertical surfaces abut when the release element is moved to the releasing position.

8. The motor vehicle door lock of claim 7, wherein the storage stage defines a release position where the tappet does not interact with the storage element.

9. The motor vehicle door lock of claim 1, wherein the storage stage is configured such that the storage element disengages the storage stage when the rotary latch is in the open position.

10. The motor vehicle door lock of claim 1, wherein the storage element is fixed and is non-rotatable relative to the triggering lever.

* * * * *